United States Patent [19]

Wilson et al.

[11] 4,039,242

[45] Aug. 2, 1977

[54] COAXIAL WET CONNECTOR

[75] Inventors: Jeffrey V. Wilson; Ronald L. Brackett, both of Camarillo, Calif.

[73] Assignee: The United States of America as represented by the Secretary of the Navy, Washington, D.C.

[21] Appl. No.: 716,870

[22] Filed: Aug. 23, 1976

[51] Int. Cl.[2] ..... H01R 17/18

[52] U.S. Cl. ..... 339/177 E; 339/117 P

[58] Field of Search ..... 339/45 R, 45 M, 94 R, 339/94 A, 94 C, 94 M, 117 R, 117 P, 177 R, 177 E

[56] References Cited

U.S. PATENT DOCUMENTS 3,398,392 8/1968 Henderson ..... 339/177 R

*Primary Examiner*—Gerald A. Dost

*Attorney, Agent, or Firm*—Richard S. Sciascia; Joseph M. St.Amand; Darrell E. Hollis

[57] ABSTRACT

A coaxial wet connector for connecting coaxial conductors of electromechanical ocean cables underwater, either by a diver or submersible manipulator. The connector comprises a male section having a male inner conductor extending outwards from a concentric male outer conductor. A female section comprises a shuttle piston for receiving the male inner conductor. An O-ring wiping seal wipes the male inner conductor clean of water as the male inner conductor drives the shuttle piston rearward within a female housing until electrical interconnection between the male and female sections is completed. A female facing lip is disposed within the female housing to mate with a male facing such that water caught in the area adjacent the shuttle piston and the male and female facings is ejected. The space between the backside of the shuttle piston and the female inner conductor is oil-filled and is in fluidic communication with a circumferential bladder. A squeeze ring surrounds the circumferential bladder and supplies a hydraulic force to the backside of the shuttle piston such that the shuttle piston is driven to its forward position, thereby disconnecting the male and female sections. A latch is provided for transferring the mechanical forces from the cable from the female outer conductor to the female housing to the male housing and back to the male outer conductor.

20 Claims, 9 Drawing Figures

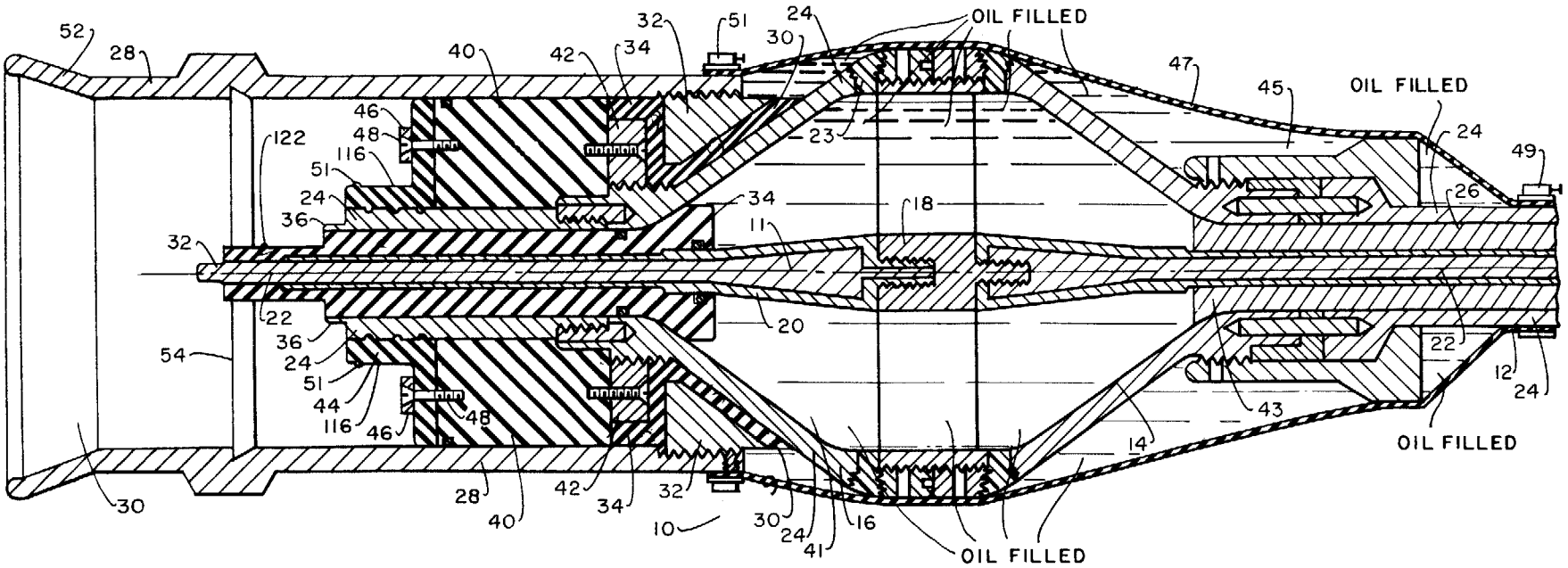
Fig. 1. MALE SECTION
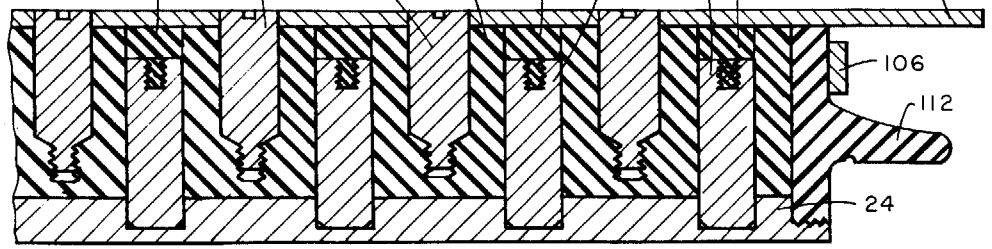
Fig. 8.
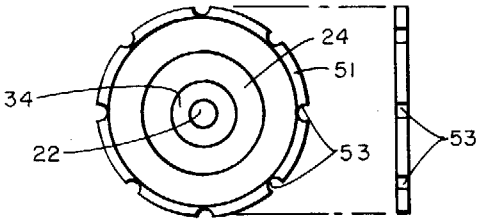
Fig. 9.

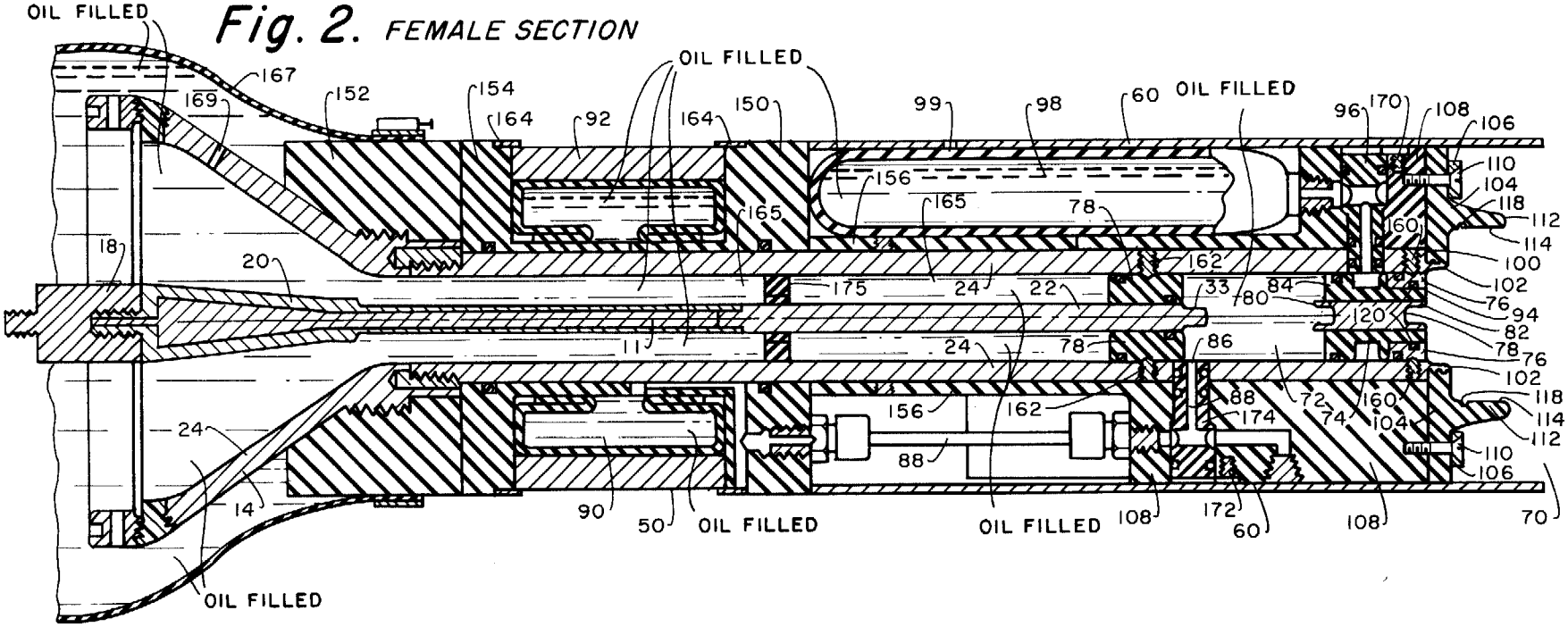
Fig. 2. FEMALE SECTION
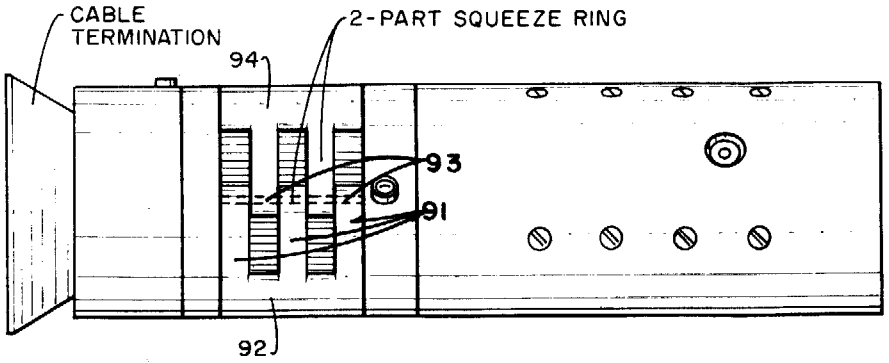
Fig. 5.

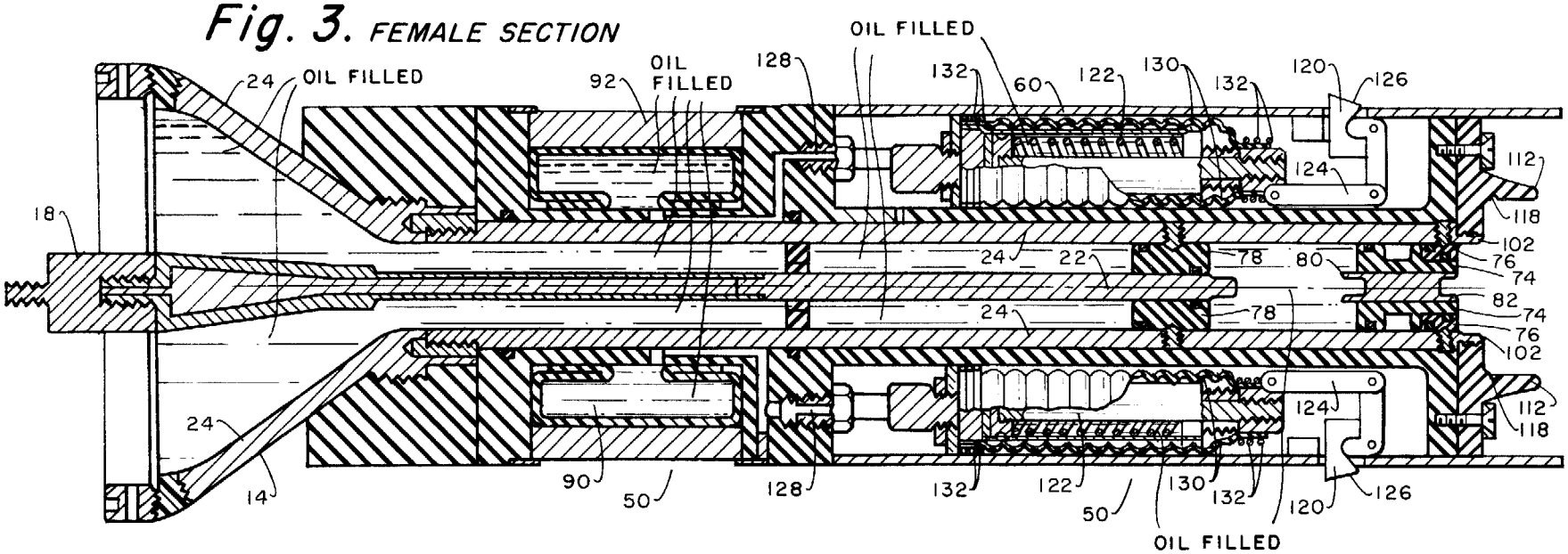
Fig. 3. FEMALE SECTION
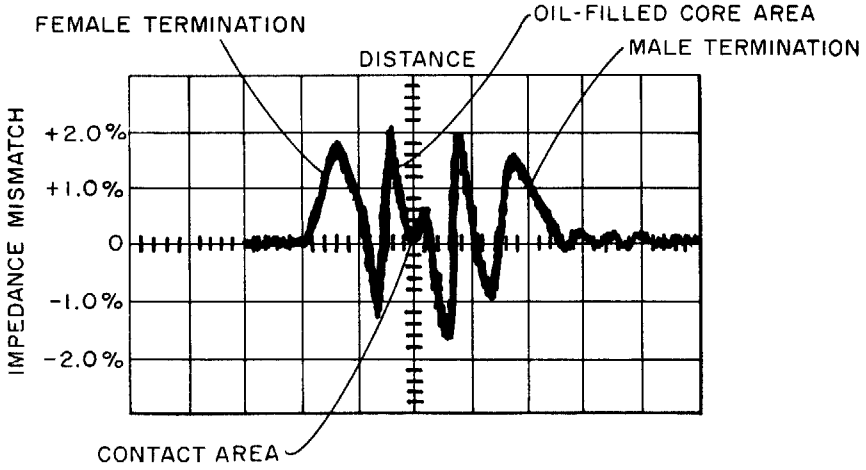
Fig. 7.
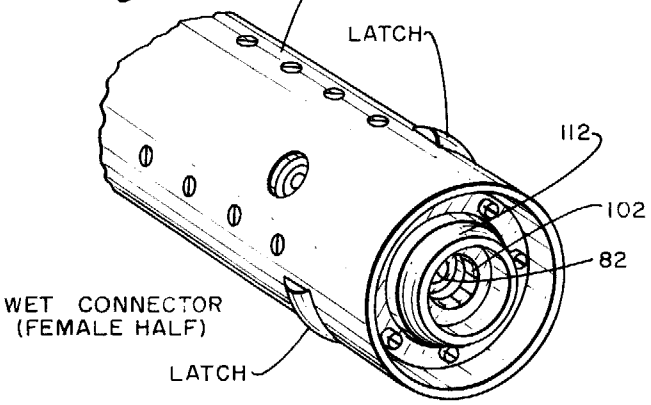
Fig. 6.

COAXIAL WET CONNECTOR

BACKGROUND OF THE INVENTION

1. Field of the Invention

This invention relates generally to underwater cable connectors and more particularly to such connectors for connection underwater.

2. Description of the Prior Art

There are no known prior art underwater connectors which can be connected underwater which provide a coaxial configuration for the conductors and which can tolerate large operating voltages of around 5,000 volts and higher.

Most prior art wet connectors are small and utilize multiple pins to effect contact. They either exhibit little appreciable mechanical strength or must use lock ring mechanisms after coupling to ensure continued mating. Accordingly, such devices are difficult for divers to handle and almost impossible for a mechanical manipulator.

Some recently developed high power wet connectors do exhibit sufficient mechanical strength as well as sufficient voltage and current carrying capability, but are difficult and cumbersome to handle and cannot carry coaxial members. In addition, such prior art wet connectors do not provide automatic latching functions nor do they provide single-action releases. Furthermore, such prior art wet connectors are limited in the depth at which they can be actuated and are not reliable for long term operation at high voltage levels because of progressive dielectric breakdown from corona effects and other material deterioration.

SUMMARY OF THE INVENTION

In order to overcome the above enumerated disadvantages, among others, the present invention provides a coaxial wet connector having a male section and a female section for electrically and mechanically connecting a coaxial cable. The present invention produces a nearly perfect impedance match while maintaining the coaxial mode of signal propagation. Also, it is depth independent since it is oil filled and has excellent long term reliability since it is pressure balanced and because liquid dielectrics hold up well under high voltages. The male section contains a male housing enclosing a male inner conductor extending outwards from a concentric male outer conductor. A flange shaped male facing is disposed concentric to the male outer conductor between the male outer conductor and the male housing, having a raised ridge attached thereto. The male housing is flared to facilitate mating. The female section contains a female outer conductor extending outwards from a female inner conductor with an interconnection space being formed within the extended portion of the outer conductor. A shuttle piston is disposed within the interconnection space. The shuttle piston contains a center conductor which engages the female inner conductor on the rear side and engages the male inner conductor on the front side. A front bulkhead retains the shuttle piston within the interconnection space The interconnection space behind the shuttle piston is filled with oil and is in fluidic communication with a circumferential bladder surrounded by a squeeze ring. When mated, the squeeze ring can exert a hydraulic force on the shuttle piston forcing it to its forward position and disconnecting the male and female sections. The female facing lip is disposed to mate with the male facing. The raised ridge of the male facing expands the female facing lip and allows seawater to flow out through vents in the raised ridge from the area adjacent the shuttle piston. The female facing lip contains a groove which engages the raised ridge as mating is completed, thereby rapidly contracting the female facing lip and ejecting the remaining water between the female facing lip and the male facing by peristaltic action. Mechanical latches are provided to transmit the mechanical forces exerted by the cable from the female outer conductor to the female housing to the male housing to the male outer conductor, thereby maintaining mechanical integrity of the connector while mated. The latches are disengaged by utilizing a hydraulic force applied concurrently with the hydraulic force on the shuttle piston.

Accordingly, one object of the present invention is to provide an underwater wet connector.

Another object of the present invention is to provide an oil-filled, pressure-compensated, coaxial wet connector.

A still further object of the present invention is to provide a nearly perfect impedance match.

Another object of the present invention is to provide for operation at high voltage.

Another object of the present invention is to increase reliability and reduce cost.

Another object of the present invention is to complete mechanical and electrical connections in one single linear motion.

A still further object of the present invention is to provide an underwater connector that is independent of operating depth.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

BRIEF DESCRIPTION OF THE DRAWINGS

FIG. 1 is a cross-sectional view of a male section of one embodiment of the present invention.

FIG. 2 is a cross-sectional view of a female section of one embodiment of the present invention.

FIG. 3 is a cross-sectional view of the female section of FIG. 2 illustrating a latch mechanism.

FIG. 5 illustrates the interlocking finger-like-extension of the squeeze ring of FIGS. 2, 3 and 4.

FIG. 6 illustrates the spring contacts shown in FIGS. 2, 3 and 4.

FIG. 7 graphically illustrates the impedance mismatch of the wet connector.

FIG. 8 illustrates the pins transferring mechanical forces from the female outer conductor to the female housing.

FIG. 9 illustrates the vents of FIGS. 2, 3 and 4.

DETAILED DESCRIPTION OF THE PREFERRED EMBODIMENT

Figure 4:
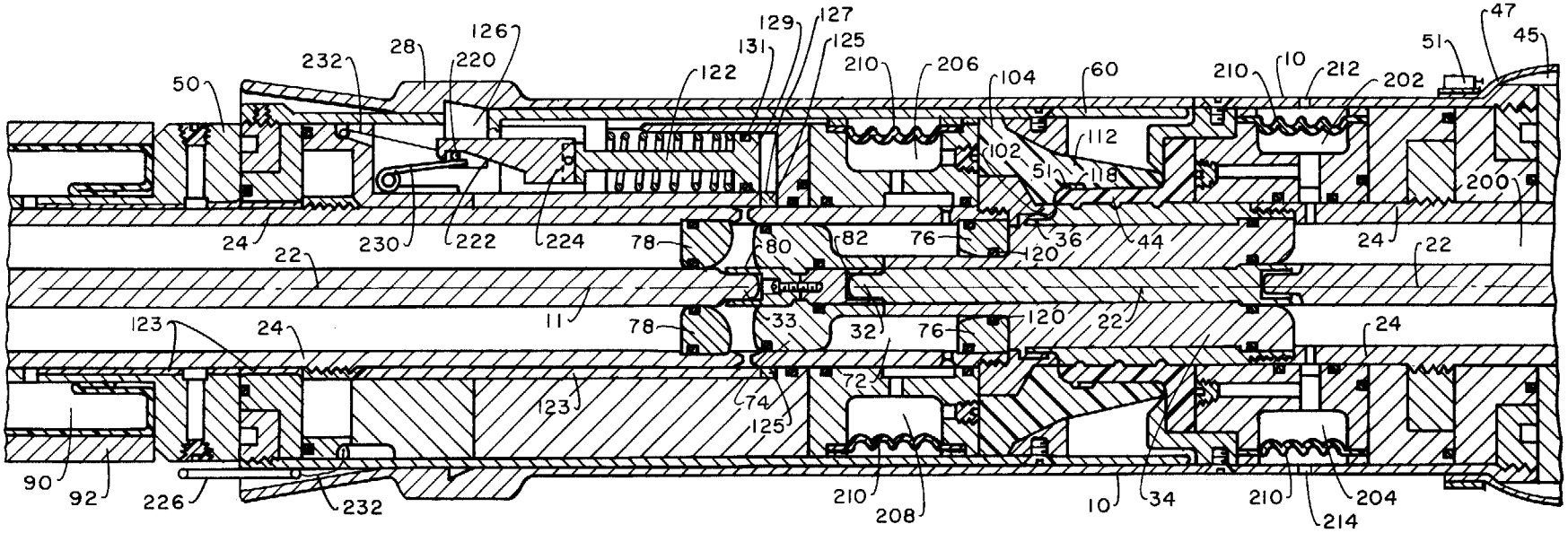
FIG. 4 is a cross-sectional view of one embodiment of the present invention after mating.

The present invention is utilized to interconnect the electrical and mechanical members of coaxial ocean cables while underwater. The connections may be made by a diver or remote manipulator. The connection may be broken at any time without flooding the cable with seawater, and may be remated underwater without loss of mechanical or electrical performance. The connectors are designed to carry the full breaking strength of the cable and to transmit electrical signals at high frequencies and at high voltages without excessive corona noise or impedance mismatch. The connectors are independent of operating depth, being oil-filled and pressure compensated. The present invention provides for coaxial configuration of the signal leads through the connector, has no rotational phase-to-phase keying requirement and may be disconnected by no more than a squeezing motion of the female section.

The connector includes two halves, a female section 50, shown in FIGS. 2 and 3, and a male section 10 shown in FIG. 1. All of the moving parts and most of the operating functions are performed in female section 50. Each connector half, female section 50 and male section 10 is attached to coaxial cable 12 by means of a modification 14 of a standard molded termination assembly developed by Bell Telephone for use with SD communications cables. Cable 12 is illustrated only in FIG. 1 for reasons of economy. It is noted that a cable 12 may be connected to female sections 50 of FIGS. 2 and 3 in like manner, as well as to male section 10 and female section 50 of FIG. 4. Of course, this termination assembly may be adapted to whatever type of cable the connector is used with. Cable 12 contains a coaxial conductor configuration with inner conductor 22 and outer conductor 24. Of course, space 43 between inner conductor 22 and outer conductor 24 is filled with a strength dielectric material 26, such as polyethylene.

Modification 14 of the standard molded termination assembly includes modified cone housing 16, spacer 18, and modified termination cone 20.

The mechanical forces exerted on outer conductor 24 by cable 12 are transferred to male housing 28 by cone ring 30, shell ring 32 and spacer ring 34. Male housing 28 is mechanically connected to male outer conductor 24 by anchor ring 42 and shell ring 32, which are electrically isolated by cone ring 30 and spacer ring 34. In addition, block ring 40 is fabricated from an electrical insulating material. Space 41 is oil filled and pressure compensated through orifice 23 which fluidically interconnects space 41 with space 45. Space 45 is oil filled and formed between boot 47 and the male section 10. Boot 47 is fabricated from a corrosion-resistant, flexible material such as neoprene or room temperature vulcanizing rubber. Boot 47 is attached in a water-tight manner to male section 10 by screw clamps 49 and 51.

Inner conductor 22 extends outwards from modification 14 within male housing 28 to a point adjacent central opening 30 of male housing 38. Inner conductor 22 has a termination end 32.

Outer conductor 24 extends outwards from modification 14 to a point further from central opening 30 than termination end 32. Male core insert 34 provides physical separation and support as well as electrical isolation between outer conductor 24 and inner conductor 22. Male core insert 34 is fabricated from a dielectric material having mechanical strength. Male core insert 34 also extends outwards from termination projection 36 of outer conductor 24 to a point adjacent termination end 32 of inner conductor 22.

Block ring 40 and anchor ring 42 provide mechanical support for outer conductor 24 within male housing 28.

Male facing 44 abuts outer conductor 24 and block ring 40. Male facing 44 is attached to block ring 40 by facing ring 46 and screws 48. Raised ridge 51 circumferentially surrounds male facing 44. Raised ridge 51 contains slots or vents 53 which are disposed parallel to longitudinal axis 11 of male housing 28, as shown in FIG. 7. Male facing 44 is fabricated from molded rubber and along with male outer conductor 24, male core insert 34 and male inner conductor 22 provide a water-tight seal between the seawater and the interior of male section 10.

Male housing 28 includes flared section 52 to facilitate the mating of male section 10 and female section 50. Male housing 28 also includes latch groove 54.

Now turning to FIG. 2, female section 50 is illustrated. Female section 50 is connected to cable 12 (not shown) via termination assembly 14 as discussed supra.

The mechanical load exerted on the mated female section 50 and male section 10 by cable 12 is transferred from outer conductor 24 located inside female housing 60 to female housing 60 by a series of anchor pins 62 and female shell pins 63 (FIG. 8). Anchor pins 62 extend through female housing 60 terminating in outer conductor 24. Anchor pins 62 are electrically sealed along female housing 60 by a plastic plug or molded seal 64. Female shell pins 63 are longitudinally in line with and behind each corresponding anchor pin 62 so that block ring 108 between the pins is loaded in compression when the male section 10 and female section 50 are in tension. Block ring 108 is fabricated from a high strength insulating plastic material. Anchor pins 62, block ring 108, and shell pins 63 exhibit sufficient mechanical strength to carry the full breaking load of the cable 12.

Outer conductor 24 extends outward from inner conductor 22 to a point adjacent central opening 70 such that interconnection space 72 is formed. Shuttle piston 74 is disposed within interconnection space 72. Shuttle piston 74 moves within interconnection space 72 between a forward position abutting front bulkhead 76 and a rear position abutting rear bulkhead 78.

Shuttle piston 74 includes an electrically conducting center conductor 78 for electrically interconnecting inner conductor 22 of female section 50 with inner conductor 22 of male section 10. The remainder of shuttle piston 74 is fabricated from an electrically insulating dielectric material.

Center conductor 78 includes spring contacts 80 and 82 for engaging inner conductor 22 of female section 50 about termination projection 33, and male section 10 about termination projection 32, respectively. Spring contact 82 is illustrated in FIG. 6.

Interconnection space 72 between backside 84 of shuttle piston 74 and rear bulkhead 78 is filled with oil or other dielectric fluid. The oil enters interconnection space 72 through orifice 86 which is the termination of hydraulic line 88. Hydraulic line 88 fluidically interconnects circumferential bladder or compensator 90 with interconnection space 72. Bladder 90 is contained within two-part squeeze ring 92. Two-part squeeze ring 92 is fabricated of metal or other structurally high strength, rigid material capable of allowing it to be squeezed by the jaw of a submersible manipulator or diver tool (not shown) with a force of up to one-thousand pounds, thereby compressing bladder 90 which applies a hydraulic force to backside 84 of shuttle piston 74. Squeeze ring 92 includes interlocking finger-like extensions 94 (FIG. 5) at the interconnections of two-part squeeze ring 92 such that a linear squeezing force by the manipulator (not shown) will produce a uniform circumferential compression of bladder 90, even if the manipulator jaws (not shown) are not perfectly aligned across the longitudinal axis 11 of female section 50. Bladder 90 and squeeze ring 92 are free-floating about female section 50 so that bladder 90 acts as a pressure compensator for the oil volume behind shuttle piston 76. That is, as the pressure on the oil within interconnection space 72 becomes greater than the pressure exerted upon bladder 90 by the sea environment, oil will flow out of interconnection space 72 and into bladder 90 and vice versa. Block rings 150 and 154 form a water-tight seal between the seawater and female outer conductor 24.

As shown in FIG. 5, two part squeeze ring 92 may be held together by pins 93. Only one pin 93 is illustrated in FIG. 5. However, there is a second pin 93 diametrically opposite the pin 93 shown in FIG. 5. Pins 93 eliminate the necessity of employing retaining straps 164 as shown in FIGS. 2 and 3. When fully extended, projections 91 of squeeze rings 92 abut pins 93 thereby preventing squeeze rings 92 from falling away from bladder 90. The oil filled compensating bladder 90 maintains two-part squeeze rings 92 centered about longitudinal axis 11.

The area adjacent front side 94 of shuttle piston 74 is fluidically connected through plastic penetrator pin 96 to compensating bladder 98. The pressure exerted on bladder 98 is the pressure from the sea environment. Bladder 98 is filled with oil so that oil flows in and out of interconnection space 72 as the pressure differential between bladder 98 and interconnection space 72 changes. Bladder 98 communicates with the sea environment through orifice 99. Block rings 108, 156, 150 form a water-tight seal between the seawater and female outer conductor 24.

Outer conductor 24 terminates adjacent central opening 70 at termination end 100. Spring contact projection 102 extends outward from termination end 100 and is shaped to mate with termination projection 36 of FIG. 1, thereby mating outer conductor 24.

Female facing 104 forms a water-tight seal between outer conductor 24 and female housing 60. Female facing ring 106 anchors female facing 104 to block ring 108 via screws 110. Female facing lip 112 extends outwards from female facing 104. Surface 114 of female facing lip 112 abuts surface 116 of male facing 44 of FIG. 1 when male section 10 and female section 50 are mated. Female facing 104, female facing lip 112 and male facing 44 of FIG. 1 are fabricated from molded rubber. When mated, surface 114 of female facing lip 112 and surface 116 of male facing 44 form a water-tight seal.

Groove 118 is located near the inner base of female facing lip 112. Raised ridge 51 on male facing 44 expands female facing lip 112 during mating, allowing seawater to flow out through vents 53 from the area adjacent front bulkhead 76 and shuttle piston 74. As mating is completed, raised ridge 51 engages groove 118 with female facing lip 112 rapidly contracting, thereby ejecting the remaining seawater between female facing 104, female facing lip 112 and male facing 44 by peristaltic action. This produces a high impedance electrical path along the interface between male section 10 and female section 50.

Front bulkhead 76 contains O-ring or wiping seal 120 Wiping seal 120 wipes male core insert 34 clean of water along surface 122 as inner conductor 22 and male core insert 34 enter interconnection space 72. Vents 53 in raised ridge 51, and the location of raised ridge 51 and groove 118 near the base of female facing lip 112, also prevent the accumulation of hydraulic overpressure on wiping seal 120 during mating, thereby preventing water leakage by wiping seal 120 into interconnection space 72.

Space 165 behind bulkhead 78 is oil-filled and pressure compensated by boot 167 through orifice 169. Boot 167 is water-tightly attached to female section 10 by screw clamp 171. An identical screw clamp (not shown) water-tightly attaches boot 167 to cable 12 (not shown). Boot 167 is oil filled. Spider 175 provides a strength dielectric member to separate female outer conductor 24 from female inner conductor 22.

FIG. 3 illustrates latches 120. Once mated, female section 50 is connected to male section 10 by two diametrically opposed latches 120 which move much like standard door latches from inside female housing 60 in their retracted position to outside female housing 60 in their extended position. Latches 120 are shown in their extended position in FIG. 3. Latches 120 are of sufficient cross-section to carry the full breaking strength of cable 12 are fabricated from a corrosion resistant metal. Latches 120 are connected to spring-loaded, single-acting hydraulic pistons 122 by linkage 124 so that the linear motion of piston 122 will produce retraction of latches 120 at right angles to the piston axis. Spring-loaded pistons 122 bias latches 120 in their fully extended position. Latches 120 are sloped along edges 126 to facilitate mating. Retraction of latches 120 is effected when a hydraulic force is applied to pistons 122 from bladder 90 through fluidic conduits 128. Latches 120 engage male section 10 at latch groove 54. Latch groove 54 allows mating of male section 10 and female section 50 without regard to rotational alignment.

It is noted that latch pistons 122 and shuttle piston 74 are connected in parallel with compensator bladder 92. Thus, shuttle piston 74 cannot move to push male section 10 and female section 50 apart until latches 120 have retracted. Also, once latches 120 are fully retracted, all additional hydraulic force is exerted directly on shuttle piston 74.

The front sides of pistons 122 are covered with bladders 130 which are oil-filled and pressure compensated to prevent deterioration of the spring by corrosion in seawater. Bladders 130 are water-tightly attached to pistons 122 by rings 132.

It is noted that the space between outer conductor 24 and inner conductor 22 is within male section 10 and female section 50 is filled with oil, such as mineral oil or castor oil. O-ring seals are shown in the drawing at appropriate places to prevent oil leakage.

Also, block rings 108, 150, 152, 154 and 156 of female section 50 are fabricated from a high strength, electrically insulating material such as plastic.

It is noted that all dielectric electrically insulating materials utilized within female section 50 and male section 10 have dielectric constants as closely matched to the dielectric constant of cable 12 as possible.

Front bulkhead 76 is held in place with set screws 160 while rear bulkhead 78 is held in place with set screws 162. Squeeze ring 92 is held in place by retaining straps 164. It is noted that appropriate O-ring seals are placed through female section 50 to prevent oil leakage between parts. Screws 170 and 172 rigidly attach penetrator pins 96 and 174, respectively, to block ring 108.

Male housing 28 and female housing 60 are fabricated from a corrosion-resistant, high-strength material.

Now turning to FIG. 4, male section 10 and female section 50 are shown mated. Note shuttle piston 74 is in its rear position with center conductor 78 electrically interconnecting inner conductor 22 between male section 10 and female section 50. Outer conductor 24 of male section 10 and female section 50 interconnect termination projection 36 and spring contact projection 102. FIG. 6 illustrates the spring contacts of spring contact projection 102 and spring contacts 80 and 82 of center conductor 78. Raised ridge 51 is shown engaging groove 118.

Male section 10 contains space 200 between inner conductor 22 and outer conductor 24 which is oil-filled and pressure compensated by pressure compensators 202 and 204. Pressure compensators 202, 204, 206, and 208 include flexible membranes 10 which have one side communicating with the sea environment which is accomplished in the case of pressure compensators 202 and 204 by orifices 212 and 214, respectively. Pressure compensators 206 and 208 perform the identical functions that bladder 98 performs in FIG. 2.

Pin 220 is attached to latch 126 and disposed to ride along inclined surface 222 of linkage 224. As linkage 224 is moved parallel to longitudinal axis 11, latch 126 moves perpendicular to longitudinal axis 11, extending and retracting latch 126. Spring 230 biases latch 126 in the extended position. Wire 232 is connected to linkage 224 at one end and ring 226 at the other end, thereby providing a manual disconnect for latches 126 should hydraulic pistons 122 fail. It is noted that oil from compensating bladder 90 flows along conduit 123, through groove 125, and then through orifice 127 to reach the back side 129 and 122.

Spring loaded piston 122 of FIG. 4 is not covered by an oil-filled pressure compensated bladder 130 as is piston 122 of FIG. 3. Rather piston 122 of FIG. 4 is fabricated from a non-corrosive material. O-ring 131 prevents oil leakage around piston 122.

FIG. 7 illustrates the impedance mismatch traversing through male section 10 and female section 50 from female termination 14 to male termination 14.

The termination of the cable must be suited to the particular cable being used. If multiple leads are involved, other single pin connections may be distributed around the central coaxial lead. A plurality of shuttle pistons may be utilized, one for each lead. If the cable is armored, the armor may be terminated normally, but in any event the strength member must be passed under the squeeze ring and compensator to allow unrestricted access by the manipulator.

There is room for considerable variation in the selection of material. The conductors should be of such conductivity that they match the materials in the cable at the frequencies of interest. The block rings within the male and female housings must approximate the dielectric constant of the cable dielectric as nearly as possible, as must the fluid dielectrics. The elastomers used for fabricating the facings are variable — a variety of soft, synthetic rubbers will suffice.

Obviously numerous modifications and variations of the present invention are possible in light of the above teachings. It is therefore to be understood that within the scope of the appended claims, the invention may be practiced otherwise than as specifically described herein.

What is claimed is:

1. An electrical coaxial wet connector, including a male and a female section for mating which produces a nearly perfect impedance match while maintaining a coaxial mode of signal propagation, comprising:

a. a female housing having a central opening therein and a longitudinal axis;

b. a female inner conductor disposed within said female housing along the longitudinal axis thereof;

c. a female outer conductor disposed within said female housing concentric with said inner conductor, said female outer conductor projecting outwards from said female inner conductor such that an interconnection space is formed within said female outer conductor, said female outer conductor having a termination end;

d. female dielectric means disposed between said linear and outer female conductors for providing electrical insulation therebetween;

e. a male housing having a central opening therein and a longitudinal axis, said male housing interfitting in abutting relationship with said female housing with said female housing being partially surrounded by said male housing after mating;

f. a male inner conductor disposed within said male housing along the longitudinal axis thereof, said male inner conductor having a termination end;

g. a male outer conductor disposed within said male housing concentric with said inner conductor, said male inner conductor projecting outwards from said male outer conductor, said male outer conductor adapted to receive said female outer conductor in electrical connection therewith;

h. male dielectric means disposed between said inner and outer male conductors for providing electrical insulation and a water-tight seal therebetween;

i. male facing means disposed concentric with said male outer conductor between said male outer conductor and said male housing, said male facing means forming a water-tight seal therebetween;

j. female facing lip means disposed concentric with said female outer conductor between said female outer conductor and said female housing, said female facing means forming a water-tight seal therebetween, said female facing lip means being adapted to receive said male facing means in abutting relationship thereto with a water-tight seal being formed therebetween after mating;

k. shuttle piston means disposed within said interconnection space for receiving said male inner conductor and electrically interconnecting said male and female inner conductors, said piston means abutting said female outer conductor and being movable with respect thereto, said piston means having a front side for receiving said male inner conductor and a back side for engaging said female inner conductor;

l. seal means disposed between said shuttle piston means and said female outer conductor adjacent said termination end for providing a water-tight seal between said shuttle piston means and said female outer conductor before mating and between said male inner conductor and said female outer conductor after mating.

2. The apparatus of claim 1 wherein said piston means includes:

a. a center conductor having spring contacts on either end, said spring contacts receiving said male inner conductor and said female inner conductor;

b. electrically insulating means circumferentially disposed about said center conductor.

3. The apparatus of claim 1 further including:
a. seal means disposed within said interconnection space for preventing said piston means from ejecting from said interconnection space;
b. core dielectric means circumferentially disposed about said male inner conductor between said termination end and said male outer conductor; and
c. wiping seals means disposed adjacent said bulkhead means for wiping said core dielectric means clean of water during mating and preventing water from entering said interconnection space.

4. The apparatus of claim 1 further including:
a. means fluidically communicating with said interconnection space for supplying fluid to said interconnection space between said back side of said piston means and said female inner conductor;
b. means for producing and transmitting a force through said fluid to the back side of said piston, thereby forcing said piston forward; and
c. compensating bladder means disposed within said female housing and being in fluidic communication with said interconnection space in front of the front side of said piston means, said compensating bladder filling said interconnection space with fluid as said piston means moves inward.

5. The apparatus of claim 4 wherein said fluid supplying means includes a circumferential bladder disposed adjacent said female housing.

6. The apparatus of claim 5 wherein said force producing and transmitting means includes a two-piece squeeze ring.

7. The apparatus of claim 6 wherein said squeeze ring includes interlocking finger-like extensions between each squeeze ring piece to produce uniform circumferential compression on said circumferential bladder.

8. The apparatus of claim 4 further including:
a. bulkhead means disposed within said interconnection space for preventing said piston means from ejecting from said interconnection space, said piston abutting said bulkhead prior to mating and abutting said female inner conductor subsequent to mating;
b. core dielectric means circumferentially disposed about said male inner conductor between said termination end and said male outer conductor;
c. wiping seal means disposed adjacent said bulkhead means for wiping said core dielectric means clean of water during mating and preventing water from entering said interconnection space as said piston moves within said interconnection space during mating and decoupling.

9. The apparatus of claim 1 wherein said male facing means includes means for ejecting seawater from the area adjacent said shuttle piston means and between said male facing means and said female facing lip means by peristaltic action during mating.

10. The apparatus of claim 9 wherein said female facing lip means includes a female lip having a circumferentially disposed groove thereon protruding outwards from a female facing base, said female lip circumferentially abutting said male facing means after mating, said groove located adjacent said female facing base.

11. The apparatus of claim 10 wherein said seawater ejecting means includes a raised ridge disposed circumferentially about said male facing means.

12. The apparatus of claim 11 wherein said raised ridge contains a plurality of vents therethrough, said raised ridge expands said female facing lip during mating such that seawater flows out of the area adjacent said shuttle piston means through said vents during mating, as mating is completed said raised ridge engages said groove such that said female facing lip contracts rapidly ejecting the remaining seawater between said female facing lip and said male facing means, said vents and the location of said raised ridge and said groove adjacent said female facing base preventing the accumulation of hydraulic overpressure on said seal means during mating.

13. The apparatus of claim 1 further including:
a. first means located between said female housing and said female outer conductor for transmitting a mechanical load from said female outer conductor to said female housing;
b. second means located within said female housing for transmitting said mechanical load from said female housing to said male housing;
c. third means located within said male housing for transmitting said mechanical load from said male housing to said male outer conductor.

14. The apparatus of claim 13 wherein said second means includes latch means disposed within said female housing for interlocking with said male housing after mating.

15. The apparatus of claim 14 wherein said male housing further includes a latch groove disposed inside said male housing for receiving said latch means.

16. The apparatus of claim 15 wherein said latch means includes:
a. plurality of diametrically opposed latch members operable to move from an unlatched position inside said female housing to a latching position outside said female housing;
b. bias means abutting said latch member for maintaining said latch member in said latching position;
c. means operable with said bias means for moving said latch member from said latching position to said unlatched position when actuated.

17. The apparatus of claim 16 wherein said bias means includes a spring.

18. The apparatus of claim 17 wherein said latch member moving means includes:
a. a plurality of hydraulic pistons, one each associated with one said latch member;
b. hydraulic means for imparting movement to said hydraulic pistons in parallel such that said hydraulic pistons force said respective latch members to said unlatched position.

19. The apparatus of claim 18 wherein said hydraulic means includes:
a. a circumferential bladder disposed adjacent said female housing;
b. a two-piece squeeze ring having finger-like extension therebetween surrounding said bladder, said squeeze ring applying a uniform circumferential compression force on said bladder when squeezed;
c. means for transmitting said compression force to said pistons, thereby imparting movement thereto.

20. The apparatus of claim 1 wherein said male housing includes a flared section for facilitating mating of said male and female sections.

* * * * *